US007137373B2

(12) United States Patent
Seymour, II et al.

(10) Patent No.: US 7,137,373 B2
(45) Date of Patent: Nov. 21, 2006

(54) VALVE LIFTER GUIDE

(75) Inventors: Kenneth R. Seymour, II, Sheboygan, WI (US); Susan L. Lukasik, Lombard, IL (US); Sriram Balaraman, Wood Dale, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/047,012

(22) Filed: Jan. 31, 2005

(65) Prior Publication Data

US 2006/0169228 A1 Aug. 3, 2006

(51) Int. Cl.
*F01L 1/14* (2006.01)

(52) U.S. Cl. ..... 123/90.5; 123/90.16; 123/90.15; 123/90.48

(58) Field of Classification Search ..... 123/90.5, 123/90.16, 90.15, 90.48
See application file for complete search history.

(56) References Cited

U.S. PATENT DOCUMENTS

| | | | | |
|---|---|---|---|---|
| 5,088,455 | A | 2/1992 | Moretz | |
| 5,546,899 | A * | 8/1996 | Sperling et al. | 123/90.5 |
| 6,143,993 | A * | 11/2000 | Andersson | 177/229 |
| 6,405,699 | B1 | 6/2002 | Church | |
| 6,745,737 | B1 | 6/2004 | Evans et al. | |

* cited by examiner

*Primary Examiner*—Thomas Denion
*Assistant Examiner*—Zelalem Eshete
(74) *Attorney, Agent, or Firm*—Susan L. Lukasik; Dennis K. Sullivan; Jeffrey P. Calfa

(57) ABSTRACT

A valve lifter guide (100) includes a base (111) and at least one conduit (101) extending from the base (111). The conduit (101) has a first inwardly curved surface (103) opposed to a second inwardly curved surface (105) such that the conduit is capable of holding a valve lifter (200) between the first inwardly curved surface (103) and the second inwardly curved surface (105).

20 Claims, 3 Drawing Sheets

FIG. 3
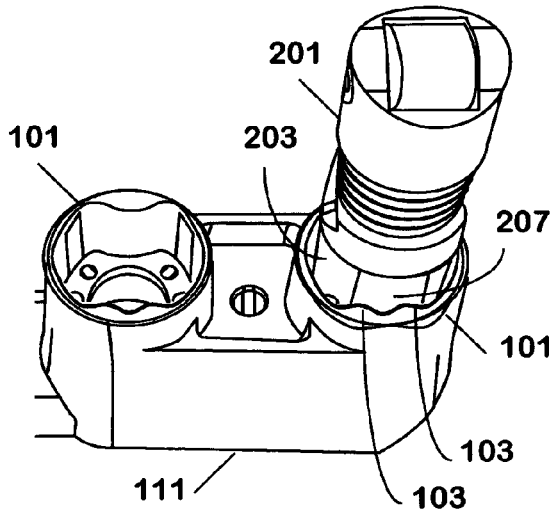
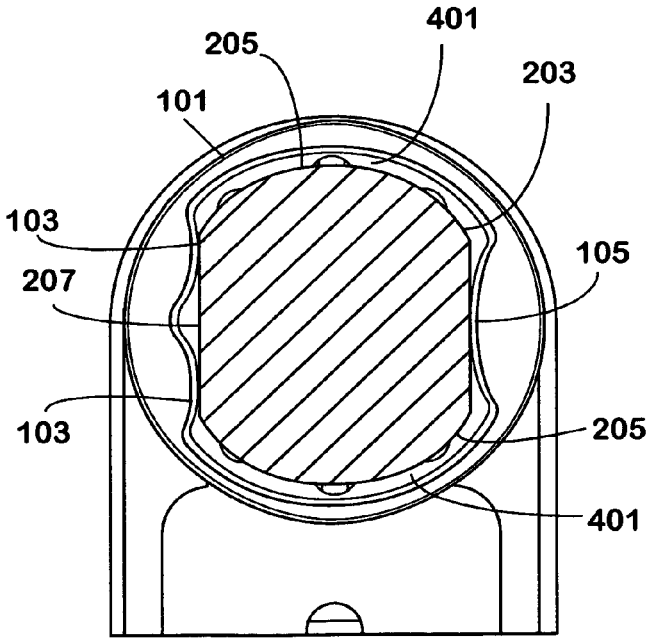
FIG. 4
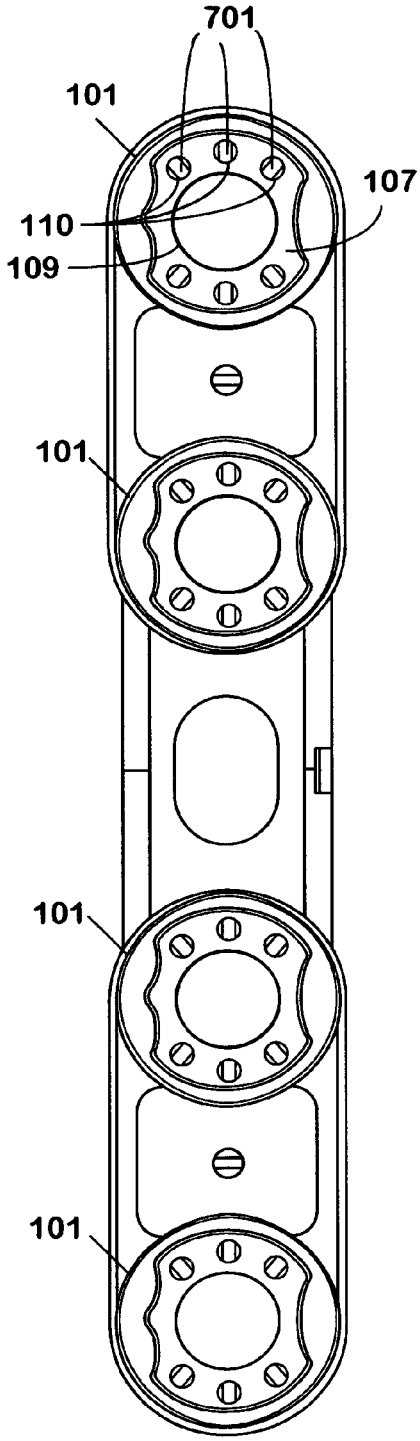
FIG. 7

VALVE LIFTER GUIDE

FIELD OF THE INVENTION

This invention relates to internal combustion engines, including but not limited to guides for valve lifters for internal combustion engines.

BACKGROUND OF THE INVENTION

Internal combustion engines are known to utilize valve lifters, also known as roller tappets, that have a roller that engages a camshaft lobe and an interface that engages a push rod at the other end. The rollers reduce friction to extend their life. The rollers need to maintain a particular orientation with respect to the camshaft to prevent damage to the rollers and/or the engine itself. For example, the roller may rotate about an axis parallel to the axis of rotation of the camshaft.

Metal guides are known to maintain the rollers in a specific orientation. Metal guides are often time-consuming and complicated to install, expensive to manufacture, and generate unwanted engine noise, in addition to suffering from wear due to metal-on-metal contact.

Accordingly, there is a need for a valve lifter guide that is inexpensive, easy to install, and does not generate unwanted engine noise.

SUMMARY OF THE INVENTION

A guide includes a base and at least one conduit extending from the base. The conduit has a first inwardly curved surface opposed to a second inwardly curved surface such that the conduit is capable of holding a valve lifter between the first inwardly curved surface and the second inwardly curved surface.

BRIEF DESCRIPTION OF THE DRAWINGS

FIG. 3 is a perspective view of a valve lifter engaging the valve lifter guide in accordance with the invention.

FIG. 4 is a top view of the valve lifter guide engaging a valve lifter in accordance with the invention.

FIG. 7 is a top view of the valve lifter guide in accordance with the invention.

DESCRIPTION OF A PREFERRED EMBODIMENT

The following describes an apparatus for and method of reliably holding a valve lifter during assembly while preventing rotation of the valve lifter during normal engine operation. A valve guide includes a number of curved surfaces arranged along the inner surface of a conduit such that the curves surfaces engage the valve lifters during assembly so as to prevent them from falling out and also to provide an orientation of the valve lifter that prevents its rotation during normal engine operation.

Figure 1:
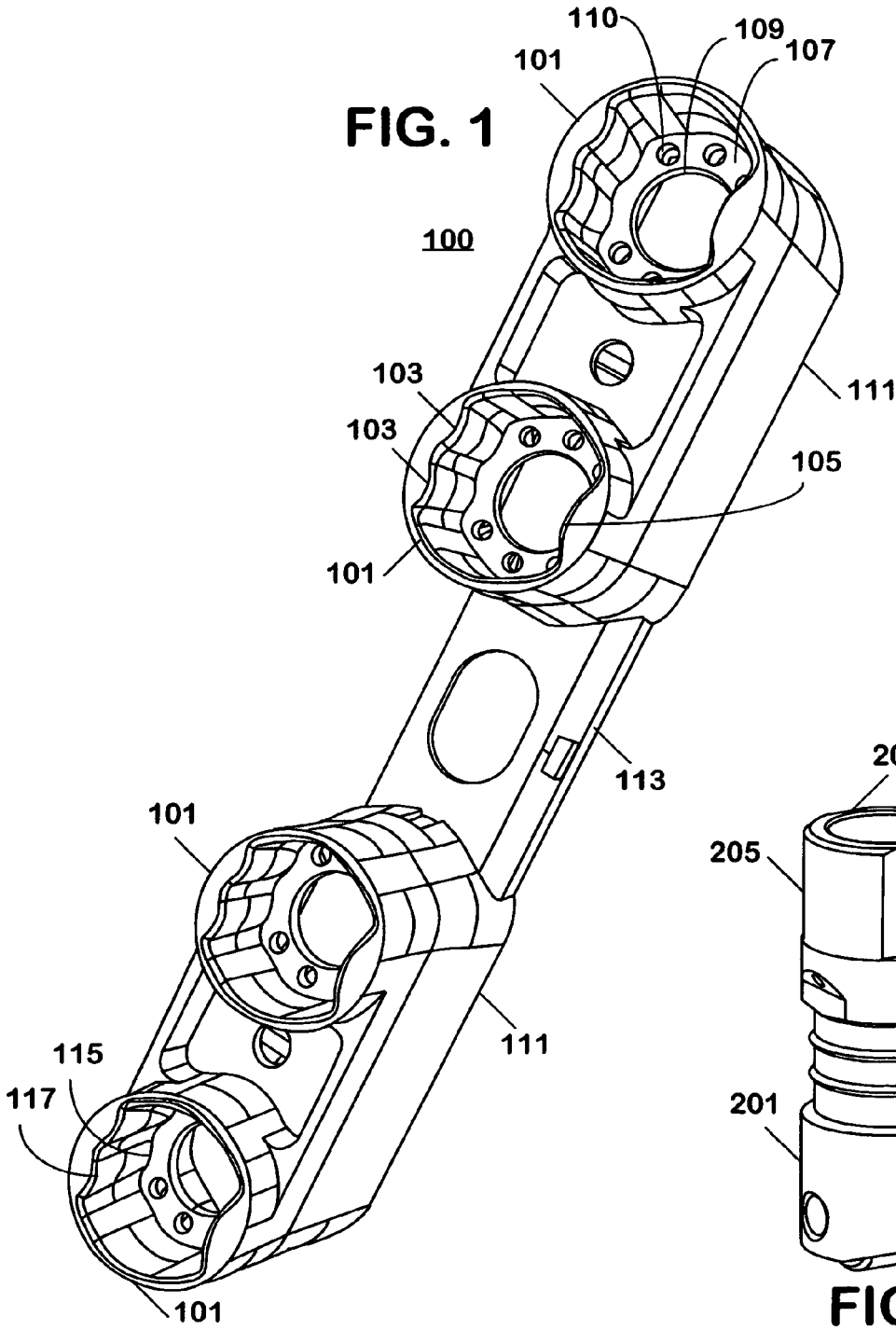
FIG. 1 is a perspective view of a valve lifter guide in accordance with the invention.
Figure 2:
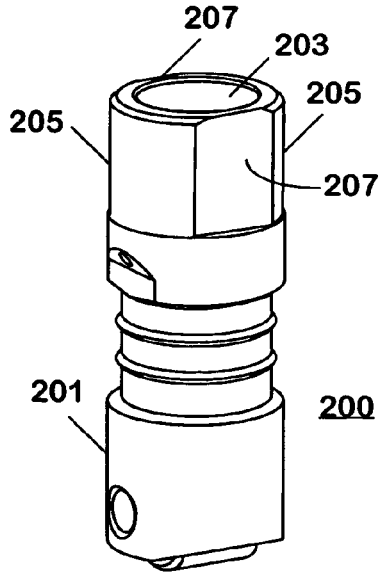
FIG. 2 is a valve lifter that engages the valve lifter guide in accordance with the invention.

A perspective view of a valve lifter guide is shown in FIG. 1. The valve lifter guide 100 includes a plurality of conduits 101 that have an outer surface that is substantially curved and an inner surface that is advantageously curved throughout the entire inner surface of the conduit 100. As shown in FIG. 1, this inner surface includes a number of inwardly curved surfaces, including a pair of curved surfaces 103 and a single curved surface 105 that oppose each other and prevent rotation of a valve lifter 200, such as shown in FIG. 2. The innermost surfaces of the inwardly curved surfaces 103 and 105 are advantageously shown incorporating a draft, i.e., the end 115 of the curved surfaces 103 and 105 at the platform 107 is not as thick as at the end 117 of the curved surfaces 103 and 105 at the upper edge of the conduit 101, while the end 115 of the curved surfaces 103 and 105 at the platform 107 is further from the center of the conduit 101 than the end 117 of the curved surfaces 103 and 105 at the upper edge of the conduit 101. The draft facilitates a tighter grip of the valve lifter 200 at the upper or outermost edge 117 of the conduit 101.

A platform 107 may be disposed inside the conduit 101. The platform 107 is advantageously planar and substantially radially disposed with respect to an axial component of the conduit 101, e.g., perpendicular to a base 111 through the center of the conduit 101. A plurality of holes 109, 110 disposed in the platform 107 includes a large hole 109 substantially in the center of the conduit 101, and, optionally, a number of smaller holes 110 near the inner surface of the conduit 101. A push rod extends from the valve lifter 200 to the cylinder head of an internal combustion engine through the large hole 109.

Two conduits 101 are shown disposed on the base 111. The two conduits 101 advantageously extend in the same direction axially, i.e., the axial orientation of the conduits 101 is substantially parallel to each other and perpendicular to the base 111. In the valve lifter guide 100 shown in FIG. 1, two bases 111 support four conduits 101. The bases 111 are connected by a link 113, such that four valve lifters 200 are guided. Optionally, a hole in the link 113 may be provided to attach the guide 100 to an engine. Although only four conduits are shown in the embodiments of the drawings, any number of conduits 101 may be included in the valve lifter guide 100, for example, 1, 2, 3, 4, 5, and so forth as needed.

A valve lifter 200 that engages the valve lifter guide 100 is shown in FIG. 2. A roller mechanism 201 is shown opposite to a lifter interface 203 that includes a pair of curved surfaces 205 opposing each other. Similarly, the lifter interface 203 includes a pair of flat surfaces 207 that are substantially parallel on opposite sides of the lifter interface 203.

A perspective view of a valve lifter 200 engaging the valve lifter guide 100 is shown in FIG. 3. A valve lifter 200 is shown inserted into one of the conduits 101 of the valve lifter guide 100. The flat surfaces 207 of the lifter interface 203 engage the curved surfaces 103 and opposing curved surface 105. In this manner, the valve lifter guide 100 securely holds the valve lifter 200 during assembly and also prevents rotation of the valve lifter 200 during engine operation.

A top view of the valve lifter guide engaging a valve lifter is shown in FIG. 4. A close-up view of a cross-section of the lifter interface 203 inserted into the conduit 101 shows engagement of the opposing flat surfaces 207 of the valve lifter 200 with the curved surfaces 103 and 105. An optional gap 401 between the curved ends 205 of the valve lifter 200 and the guide 100 advantageously provides play in how the valve lifter 200 fits within the valve lifter guide 100. The gap 401 provides a more flexible way for the valve lifters 200 with respect to the push rods of the internal combustion engine. Although it is advantageous that the curved surfaces 103 and 105 provide an interference fit with the flat surfaces 207 of the valve lifter 200, a looser fit may be provided between the components, so long as rotation of the valve lifter 200 is prevented during engine operation. Lubricating oil as well as air to moves between the valve lifter 200 and the inner surface of the conduit 101 at the gaps 401.

Figure 5:
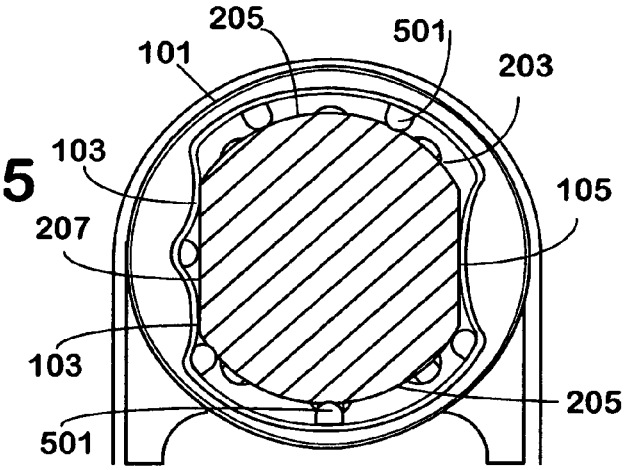
FIG. 5 and FIG. 6 are top views of the valve lifter guide engaging a valve lifter at optional locations in accordance with the invention.
Figure 6:
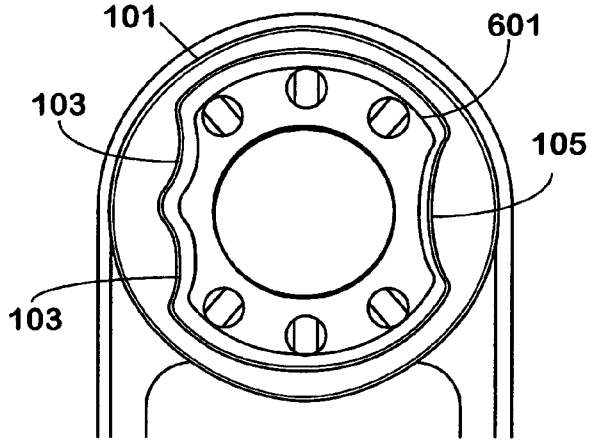

A top view of the valve lifter guide engaging a valve lifter at an optional location is shown in FIG. 5. Assembly structures 501 may optionally be provided either extending from or near the platform surface 107 to more closely engage the valve lifter 200 during assembly. These assembly structures 501, such as small rounded teeth, are close enough to the platform 107 such that they engage the valve lifter during assembly, but do not interfere with the movement of the valve lifter 200 during normal engine operation. If, for example, the valve lifter 200 remains 5 mm from the platform 107 during operation, the assembly structures 501 may be 3 mm or 4 mm from the platform 107. An alternative assembly structure 601 shown in FIG. 6 incorporates a smaller mimic of the curved shape of the inner edge surface of the conduit 101, disposed on the platform 107, but slightly radially inward of end 115 of the curved surfaces. The inner surface of the assembly structure 601 advantageously has an interference fit with the outer surface of the lifter interface 203 of the valve lifter 200 during assembly, but does not touch the valve lifter 200 during normal engine operation.

Figure 8:
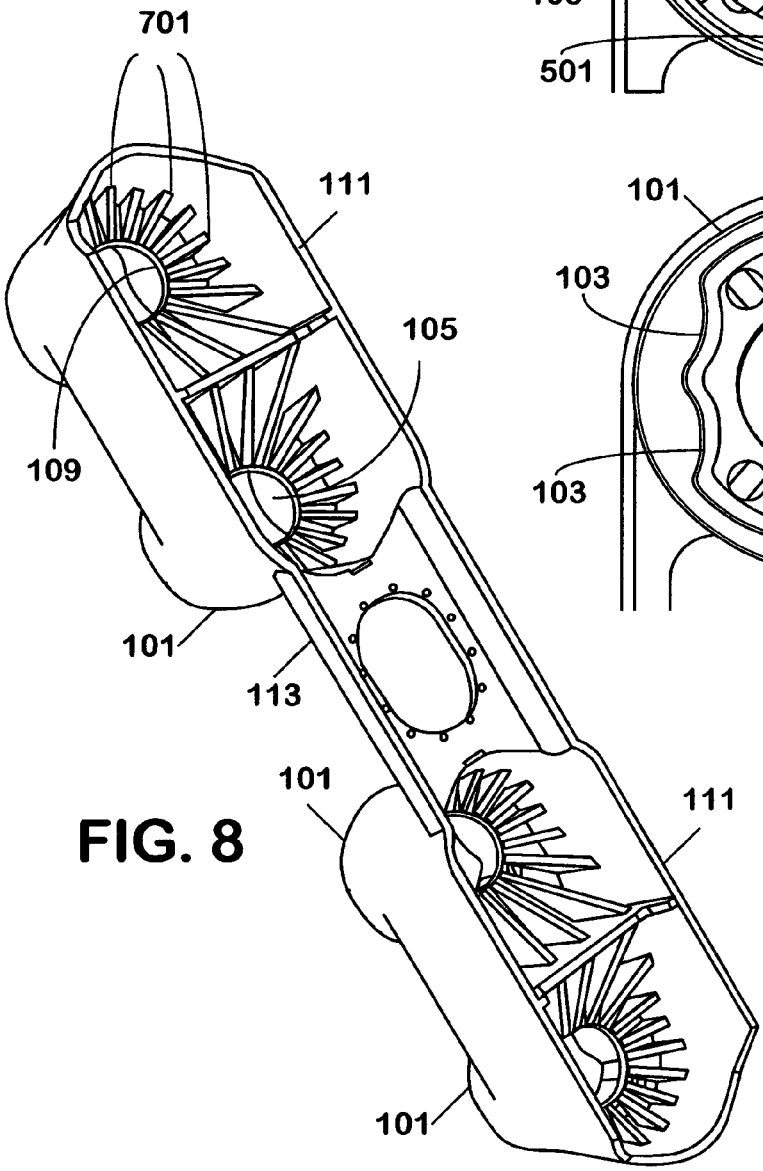
FIG. 8 is a bottom view of a valve lifter guide in accordance with the invention.

A top view of the valve lifter guide is shown in FIG. 7. A plurality of ribs 701 are shown disposed through the smaller holes 109 in the platform 107. This arrangement is advantageously repeated in each of the conduits of the valve lifter guide. A bottom view of the valve lifter guide 100, as shown in FIG. 8, shows the ribs 701 from below. The ribs 701 provide support between the platform 107 and the base 111. The ribs 701 also help guide the pushrod into the valve lifter 200.

The guide 100 is advantageously made of plastic, nylon, resin, or other suitable material, such as Nylatron® GS 51 plastic from K-mac Plastics, Zytel® nylon from DuPont, or Hylon® N1033 resin from Entec. Strain relief (not shown) may additionally be provided as needed, for example, by eliminating sections of the material, as known in the art. Optionally, the valve guide 100 may be advantageously designed to allow the materials to stretch or flex, as needed, to receive and/or eject the valve lifter(s) 200. Such design may include, for example, cut-outs in the material at strategic places, thinner areas of material, and/or use of more stretchable/flexible materials.

The present invention provides numerous advantages, including being inexpensive, easy to install, and not generating unwanted engine noise. During installation, valve lifters are securely held. More grip of valve lifters results in, more securely held parts than with designs, for example, that incorporate a flat-sided two-finger approach. During engine operation, rotation is prevented.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A valve lifter guide comprising:

a base;

at least one conduit extending from the base, wherein the conduit has a first inwardly curved surface opposed to a second inwardly curved surface such that the conduit holds a valve lifter between the first inwardly curved surface and the second inwardly curved surface while preventing rotation of the valve lifter.

2. The guide of claim 1, wherein the first inwardly curved surface comprises at least two inwardly-oriented curves.

3. The guide of claim 1, further comprising a platform disposed in the conduit substantially radially with respect to an axial aspect of the conduit.

4. The guide of claim 3, wherein the platform comprises one or more holes, and wherein one of the one or more holes is capable of facilitating a push rod that engages the valve lifter.

5. The guide of claim 1, further comprising a plurality of ribs disposed in the base opposite to the conduit.

6. The guide of claim 1 comprising at least two conduits, both extending in one direction from the base.

7. The guide of claim 1, wherein the conduit has a continuously curving inner surface.

8. The guide of claim 1, further comprising at least one assembly structure capable of engaging the valve lifter during assembly into an engine.

9. The guide of claim 1, wherein the first inwardly-curved surface comprises a first contact site and a second contact site and the second inwardly-curved surface comprises a third contact site, such that the third contact site is not directly opposite to the first contact site and the third contact site is not directly opposite to the second contact site.

10. A valve lifter guide comprising:

a base;

a first conduit extending from the base, wherein the first conduit has a first inwardly curved surface opposite from a second inwardly curved surface, wherein the first inwardly curved surface engages a first surface of a valve lifter while the second inwardly curved surface engages a second surface of the valve lifter, which second surface is substantially parallel to the first surface, while preventing rotation of the valve lifter.

11. The guide of claim 10, wherein the first inwardly curved surface comprises at least two inwardly-oriented curved surfaces.

12. The guide of claim 10, further comprising a platform disposed in the first conduit substantially radially with respect to an axial aspect of the conduit.

13. The guide of claim 12, wherein the platform comprises a plurality of holes, and wherein one of the holes is capable of facilitating a push rod that engages the valve lifter.

14. The guide of claim 10, further comprising a plurality of ribs disposed in the base opposite to the first conduit.

15. The guide of claim 10, further comprising a second conduit extending in the same direction from the base as the first conduit extends from the base.

16. The guide of claim 10, further comprising a second base having at least two conduits extending from the second base in the same direction from the base as the first conduit extends from the base.

17. The guide of claim 10, wherein the first conduit has a continuously curving inner surface.

18. The guide of claim 10, wherein the first conduit has a substantially curved outer surface.

19. The guide of claim 10, further comprising at least one assembly structure capable of engaging the valve lifter during assembly into an engine.

20. A valve lifter guide comprising:

a base;

at least one conduit extending from the base, wherein the conduit comprises a first side having a first inwardly curved surface and a second side having a second inwardly curved surface and a third inwardly curved surface, wherein the first side of the conduit is opposed to the second side of the conduit, such that the conduit engages a first surface of a valve lifter with the first inwardly curved surface and a second surface of the valve lifter with the second inwardly curved surface and third inwardly curved surface, while preventing rotation of the valve lifter.

* * * * *